United States Patent [19]

Pan

[11] Patent Number: 4,792,301

[45] Date of Patent: Dec. 20, 1988

[54] METHOD AND FURNACE APPARATUS FOR CONTINUOUSLY HEATING STEEL BLANKS

[76] Inventor: Daiming Pan, No. 1 Bldg. 40, Guchengnan Road, Shijingshan District, Beijing, China

[21] Appl. No.: 92,241

[22] Filed: Sep. 2, 1987

Related U.S. Application Data

[63] Continuation-in-part of Ser. No. 845,306, Mar. 29, 1986, abandoned.

[30] Foreign Application Priority Data

Apr. 1, 1985 [CN] China ..... 85102032

[51] Int. Cl.[4] ..... F27B 9/40

[52] U.S. Cl. ..... 432/52; 432/5; 432/6; 432/9

[58] Field of Search ..... 432/6, 9, 10, 13, 25, 432/52, 70, 121, 162, 181, 183, 231, 248, 252, 258, 153, 241; 266/214, 261, 262

[56] References Cited

U.S. PATENT DOCUMENTS

| | | | |
|---|---|---|---|
| 1,046,933 | 12/1912 | Allis | 432/6 |
| 1,367,000 | 2/1921 | Allis | 432/6 |
| 2,677,538 | 5/1954 | Blans et al. | 432/6 |
| 2,966,349 | 12/1960 | Griffiths | 432/6 |
| 3,099,437 | 7/1963 | Bloom | 432/52 |
| 3,556,493 | 1/1971 | Knaak | 432/9 |
| 3,795,478 | 3/1974 | Knaak | 432/25 |
| 3,969,069 | 7/1976 | Knaak | 432/25 |
| 4,310,301 | 1/1982 | Mayers et al. | 32/241 |
| 4,348,175 | 9/1982 | Molina | 432/241 |
| 4,721,459 | 1/1988 | Fitz | 432/241 |

*Primary Examiner*—Henry C. Yuen

*Attorney, Agent, or Firm*—David H. Semmes

[57] ABSTRACT

An intermittent flames, heated bed type furnace and a method for heating steel plate. The furnace and method for heating solve problems inherent in conventional furnaces, namely, consuming too much energy, having low efficiency, and providing a heat which is unstable and non-uniform in quality. The invention includes a modified furnace with a special heated bed, the furnace having a wide or square body to replace the conventional rectangular type of furnace, thus enlarging its loading volume. To improve product quality, a combined or continuous operational heating sequence is substituted for the conventional intermittent or batch heating mode, thus raising labor productivity. The overall effectiveness obtained by this invention has increased from 1 to 3 times the productivity of a conventional intermittent flame furnace, while decreasing energy consumption by 30 to 70 percent. Deflection of the size of the steel plate or end is only a fraction of that specified in conventional standards. Also, there is minimal oxidization on the surface of the steel plate and good appearance is maintained. Consequently, it is not necessary to polish, select, and fit the plate when used as the sealing end of a cylinder body or tank to be welded, the exchangeability being 100 percent.

3 Claims, 5 Drawing Sheets

TABLE 3

IN/OUT SEQUENCE, POSITION AND HEATING TIME OF BLANKS (FURNACE TEMP: 1000°C; THICKNESS OF THE BLANK: 14mm)

| BATCH | SEQUENCE NO. | POSITION | TIME / HEATING TIME | 2' | 4' | 6' | 8' | 10' | 17' | 19' | 21' | 23' | 25' | 27' | 33' | 35' | 37' | 39' | 41' | 43' | 47' | 49' | 51' | 53' | 55' | 57' | 60' | 62' | 64' | 66' | 68' | 70' | 72' | 74' | 76' | 78' | 80' | 82' |
|---|---|---|---|---|---|---|---|---|---|---|---|---|---|---|---|---|---|---|---|---|---|---|---|---|---|---|---|---|---|---|---|---|---|---|---|---|---|---|
| 1 | 1 | A | 0' | 2' | 4' | 6' | 8' | 10' | 17' | | | | | | | | | | | | | | | | | | | | | | | | | | | | | |
| | 2 | E | | 0' | 2' | 4' | 6' | 8' | 15' | 17' | | | | | | | | | | | | | | | | | | | | | | | | | | | | |
| | 3 | C | | | 0' | 2' | 4' | 6' | 13' | 15' | 17' | | | | | | | | | | | | | | | | | | | | | | | | | | | |
| | 4 | F | | | | 0' | 2' | 4' | 11' | 13' | 15' | 17' | | | | | | | | | | | | | | | | | | | | | | | | | | |
| | 5 | B | | | | | 0' | 2' | 9' | 11' | 13' | 15' | 17' | | | | | | | | | | | | | | | | | | | | | | | | | |
| | 6 | D | | | | | | 0' | 7' | 9' | 11' | 13' | 15' | 17' | | | | | | | | | | | | | | | | | | | | | | | | |
| 2 | 7 | A | | | | | | | 0' | 2' | 4' | 6' | 8' | 10' | 16' | | | | | | | | | | | | | | | | | | | | | | | |
| | 8 | E | | | | | | | | 0' | 2' | 4' | 6' | 8' | 14' | 16' | | | | | | | | | | | | | | | | | | | | | | |
| | 9 | C | | | | | | | | | 0' | 2' | 4' | 6' | 12' | 14' | 16' | | | | | | | | | | | | | | | | | | | | | |
| | 10 | F | | | | | | | | | | 0' | 2' | 4' | 10' | 12' | 14' | 16' | | | | | | | | | | | | | | | | | | | | |
| | 11 | B | | | | | | | | | | | 0' | 2' | 8' | 10' | 12' | 14' | 16' | | | | | | | | | | | | | | | | | | | |
| | 12 | D | | | | | | | | | | | | 0' | 6' | 8' | 10' | 12' | 14' | 16' | | | | | | | | | | | | | | | | | | |
| 3 | 13 | A | | | | | | | | | | | | | 0' | 2' | 4' | 6' | 8' | 10' | 14' | | | | | | | | | | | | | | | | | |
| | 14 | E | | | | | | | | | | | | | | 0' | 2' | 4' | 6' | 8' | 12' | 14' | | | | | | | | | | | | | | | | |
| | 15 | C | | | | | | | | | | | | | | | 0' | 2' | 4' | 6' | 10' | 12' | 14' | | | | | | | | | | | | | | | |
| | 16 | F | | | | | | | | | | | | | | | | 0' | 2 | 4' | 8' | 10' | 12' | 14' | | | | | | | | | | | | | | |
| | 17 | B | | | | | | | | | | | | | | | | | 0' | 2' | 6' | 8' | 10' | 12' | 14' | | | | | | | | | | | | | |
| | 18 | D | | | | | | | | | | | | | | | | | | 0' | 4' | 6' | 8' | 10' | 12' | 14' | | | | | | | | | | | | |
| 4 | 19 | A | | | | | | | | | | | | | | | | | | | 0' | 2' | 4' | 6' | 8' | 10' | 13' | | | | | | | | | | | |
| | 20 | E | | | | | | | | | | | | | | | | | | | | 0' | 2' | 4' | 6' | 8' | 11' | 13' | | | | | | | | | | |
| | 21 | C | | | | | | | | | | | | | | | | | | | | | 0' | 2' | 4' | 6' | 9 | 11' | 13' | | | | | | | | | |
| | 22 | F | | | | | | | | | | | | | | | | | | | | | | 0' | 2' | 4' | 7' | 9' | 11' | 13' | | | | | | | | |
| | 23 | B | | | | | | | | | | | | | | | | | | | | | | | 0' | 2' | 5' | 7' | 9' | 11' | 13' | | | | | | | |
| | 24 | D | | | | | | | | | | | | | | | | | | | | | | | | 0' | 3' | 5' | 7' | 9' | 11' | 13' | | | | | | |
| 5 | 25 | A | | | | | | | | | | | | | | | | | | | | | | | | | 0' | 2' | 4' | 6' | 8' | 10' | 12' | | | | | |
| | 26 | E | | | | | | | | | | | | | | | | | | | | | | | | | | 0' | 2' | 4' | 6' | 8' | 10' | 12' | | | | |
| | 27 | C | | | | | | | | | | | | | | | | | | | | | | | | | | | 0' | 2' | 4' | 6' | 8' | 10' | 12' | | | |
| | 28 | F | | | | | | | | | | | | | | | | | | | | | | | | | | | | 0' | 2' | 4' | 6' | 8' | 10' | 12' | | |
| | 29 | B | | | | | | | | | | | | | | | | | | | | | | | | | | | | | 0' | 2' | 4' | 6' | 8' | 10' | 12' | |
| | 30 | D | | | | | | | | | | | | | | | | | | | | | | | | | | | | | | 0' | 2' | 4' | 6' | 8' | 10' | 12' |

FIG. 10

METHOD AND FURNACE APPARATUS FOR CONTINUOUSLY HEATING STEEL BLANKS

CROSS REFERENCES TO RELATED APPLICATIONS

A continuation-in-part of applicant's earlier filed "Furnace with Special Heated Bed and Combined Technology for Heating the Steels with It" (Ser. No. 845,306), filed Mar. 29, 1986 now abandoned.

The present invention contains additional illustrations and a schematic layout of the furnace controls.

BACKGROUND OF THE INVENTION (1) Field of the Invention

Heating furnaces for steel plate, particularly an intermittent flame furnace having a wide body construction, enabling continuous charging and removal of steel plate while acheving enhanced energy efficiency.

2. Description of the Prior Art

Being discussed in a separately filed Information Disclosure Statement.

SUMMARY OF THE INVENTION

A modified intermittent flame furnace having a wide or square body construction and a method of charging the furnace with steel plate in an array of horizontal layers, so as to achieve energy saving and enhanced heating of the steel plate.

DESCRIPTION OF THE DRAWINGS

FIG. 10 is "Table 3" depicting "In/Out Sequence, Position and Heating Time of Blanks".

DESCRIPTION OF THE PREFERRED EMBODIMENTS

A wide or "square" body furnace and a method for continuous combined sequence heating of steel plates. Particularly, the furnace, according to the present invention, is used in heating steel plates used as a sealing end in cylinders or tubes, prior to assembly by welding or forging. The furnace includes an adjustable heated bed and end wall combination. The adjustable heated bed and end wall combination may be employed in the design of a new furnace or retrofitted as a modification to an old furnace.

Figure 1:
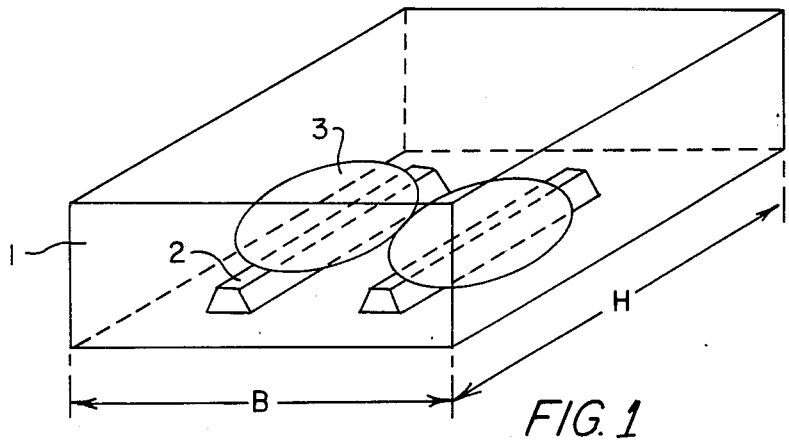
FIG. 1 is a schematic view, showing a conventional furnace 1 having iron pads 2 for supporting steel plate blanks 3.

The prior art or conventional furnace has its own disadvantages which can be briefly described by way of example, i.e. in the heating of steel blanks used as sealing end plates. The conventional heating furnace is designed to heat the largest blank under conditions prescribed for obtaining a specified rate of production. When heating small blanks, the actual rate of production of furnace 1 illustrated in FIG. 1 is in fact only 30 to 70 percent of the specified rate of production, as will be apparent. The conventional furnace structure has a narrow body (i.e. depth $H \geqq$ width B). Since it is difficult to get blanks 3 into and out of the bottom of conventional furnace 1, the space in the bottom or floor of the furnace is often open or free. Thus, the heat energy of the conventional furnace cannot be used efficiently, and a high energy consumption occurs. In actual operation and when heating, one to four steel plate blanks 3 are placed as a single layer or horizontal plane on the strip iron pads (FIG. 1). For a steel plate or sealing end 3 having a nominal diameter e.g. $\leqq$450 mm, blank 3 may be laid on the furnace bottom. Thus, the furnace can only be operated and heated in an intermittent way, with the result that the overall operational rate is limited, since operation depends upon other equipment, such as a forklift, and the availability of personnel. The various heating times of differently sized steel plates or equipment to be heated place the process out of balance. Intermittently charging and removing the steel blanks in batches in turn varies the sequence of the individual blanks within the same batches in being placed in or removed from the furnace. As a result, the degree of heat provided is not the same for all blanks. Consequently, deflection in the size of the plate or sealing end product after forging is greater than desired, and steel plate quality becomes unstable and non-uniform, being often inferior to conventional standards (i.e., JB 741-80).

The object of the present invention is to provide a furnace with a special heated bed and a combined method for heating steel blanks within it, while increasing labor productivity, improving product quality and reducing energy consumption in the furnace.

Figure 2:
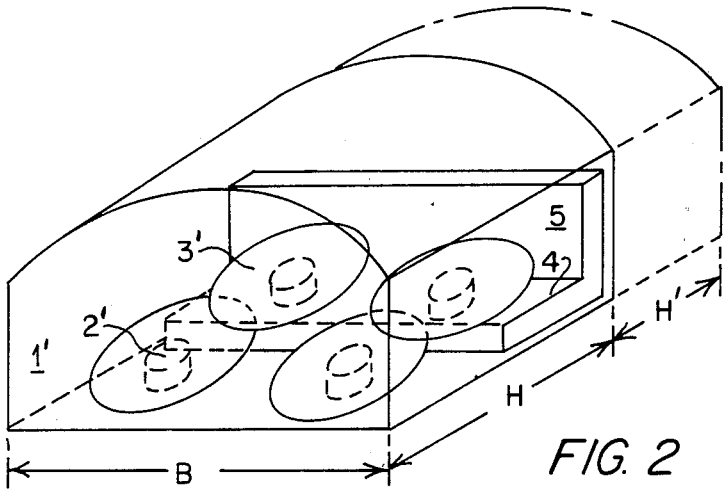
FIG. 2 is a schematic view, showing furnace 1', modified according to the present invention, such that a special heated bed 4 and heated wall 5 are used to foreshorten the confined chamber of furnace 1' and hollow mounds 2 are employed for layered support of blanks 3' in an array of horizontal layers.

The furnace according to the present invention is a wide or square body type of furnace. Its structural feature is that the width $B \geqq$ depth H in the furnace. As illustrated in FIG. 2, an existing narrow type of conventional furnace 1' could be retrofitted into wide or square body, using partition wall 5 and bed 4. The effective use of the bottom area in a thusly modified furnace is much greater for this wide or square body furnace. Since the modified furnace 1' is wide and shallow, blanks 3' supported by fork lift, may be delivered to available space within the chamber of furnace 1'. As a result, the modified furnace 1' easily accommodates blanks 3' positioned in a plurality of horizontal layers for heating in a partially overlapping arrangement and thereby increases the load of the furnace. This layered arrangement will also enable continuous heating, while passing the blanks into and out of the furnace.

In the prior art furnace illustrated in FIG. 1, blanks 3 were put in a single layer or horizontal plane and later heated. Blanks 3 were supported on iron pads 2 in strip form. As will be apparent, the quantity of blanks 3 which could be heated within furnace 1 was limited, and heat accepted by the blanks was not uniformly distributed in a circumferential direction, exerting an adverse effect during subsequent forging.

As will be apparent in FIG. 2, the modified furnace and method makes better use of that space within furnace 1' in which blanks 3' are put in an array of layers and partially overlapped. Also, within modified furnace 1', blanks 3' are supported during heating upon circular hollow mounds 2' of varying heights. As a result, both productivity and product quality are improved. Circular hollow mounds 2' are made of metal or refractory materials. The varying heights of circular hollow mounds 2' may be in the range of 200 to 1000 mm. Due to the overlapping arrangement, consistent space heating is efficient for blanks 3' that are individually supported upon hollow mounds 2' of different heights. His procedure not only uses effectively the bottom area of furnace 1', but also makes better use of the whole interior space within furnace 1', effectively double its load. Taking steel blank 3' heated in a 3.1M×2.4M furnace as an example, 4 to 6 blanks 3' having a nominal diameter from 500 to 1000 mm can be loaded within a conventional furnace. In the modified furnace, 6 to 16 pieces having a diameter ≦450 mm can be loaded and heated. Thus, load quantity can be raised 1 to 3 times. This plurality of layers arrangement favors circulation of the combustion product and of making better use of heating energy within the interior of furnace 1', thereby increasing the heating rate and improving heating quality.

Heating blanks 3' may be laid in a plurality of layers due to the wide body or square dimensions of the modified furnace. This construction has vastly improved the operation from the prior art intermittent batch furances and provided conditions for a continuous processing.

Figure 3:
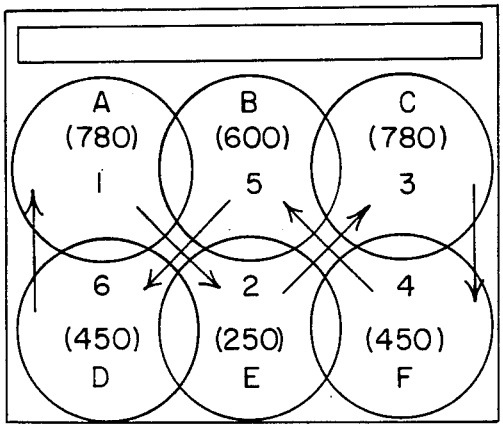
FIG. 3 is a plan view of a furnace according to the present invention and showing the arrangement for layered support and charging and removing of six steel plate blanks or workpieces.

Many tests have been carried out with the present invention. These tests have included a series of measuring, analysis, and optimization studies for production and management, involving about 30 factors. The invention has enabled continuous heating while charging and removing steel blanks 3' in continuous sequence. The basic elements of the method in sequence or continuous processing include:

(a) partially overlapped and arranged blanks in an array of spaced, horizontal layers;
(b) the arrangement of blanks 3 is determined by blank diameter and furnace size, as well as operating time of equipment;
(c) each blank has its own fixed position and height within the furnace;
(d) strict sequence of charging and removing of the numbered blanks, as illustrated in FIG. 3;
(e) solving the problems of controlling furnace temperature, blank temperature, mould temperature and temperature adjustment to overcome ambient temperature variation; and
(f) determining heating time in accordance with the operating time of the furnace, mould temperature change, blank diameter and blank thickness.

According to such parameters as blank size specification, the quantity of pieces and number of layers laid, heating temperature, heating time, and the like, a combined operation with rhythm and continuous processing has been achieved. Not only is modified furnace 1' in a full load from beginning to end, but also the equipment is highly efficient; and labor productivity is doubled. Deflection from the specified dimensions of the sealing plate product is only a fraction of that specified in standard JB 741-80. Also, minimal oxidation and a good appearance are obtained.

The load in a conventional furnace, using sequenced charging, increases as the plates are charged and removed and, as the opening of the furnace door is frequent, heat loss increses and there is increasing fluctuation in furance temperatures. This is one of the reasons why sequence operation according to the present invention cannot be accomplished in conventional heating furnaces. Accordingly, applicant has devised bed 4 and wall 5. After mounting wall 5 inside furnace 1', thermal capacity in the chamber of the furnace is increased, making its temperature more stable and balanced within the specified temperature fluctuation range, thus assuring that sequenced charging and removing of steel blanks can be achieved with high efficiency. The special heated wall 5 is built using refractory brick or special refractory building blocks which are laid in the front of the rear wall in the furnace, and special bed 4 is supported on the furnace bed. Adequate space and passages (not illustrated) extend through bed 4 and wall 5 for diffusion and exchange of heat. As illustrated in FIG. 2, special bed 4 and wall 5 volume constitutes 8 to 16 percent of the total interior volume of the furnace.

PREFERRED EMBODIMENT

Figure 5:
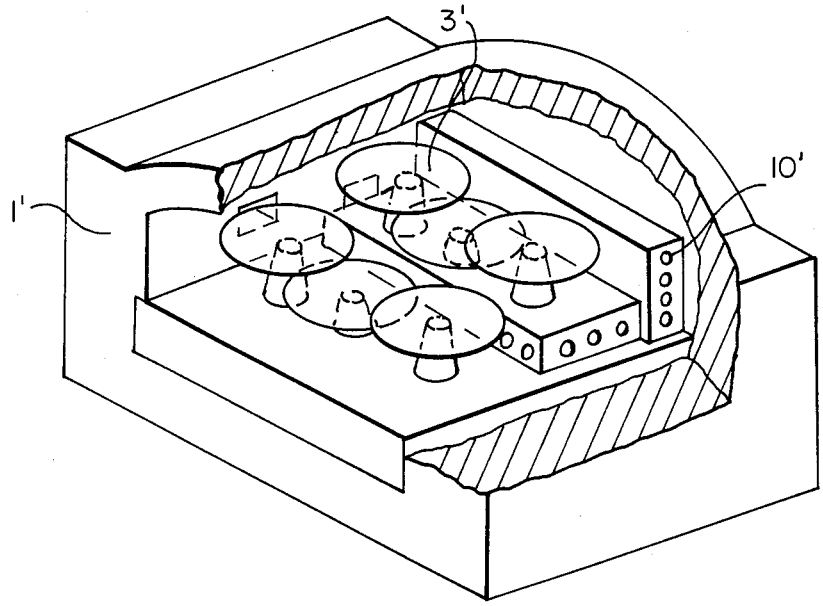
FIG. 5 is a fragmentary perspective view, partially in section, showing six steel plates mounted upon circular mounds of varying height.
Figure 6:
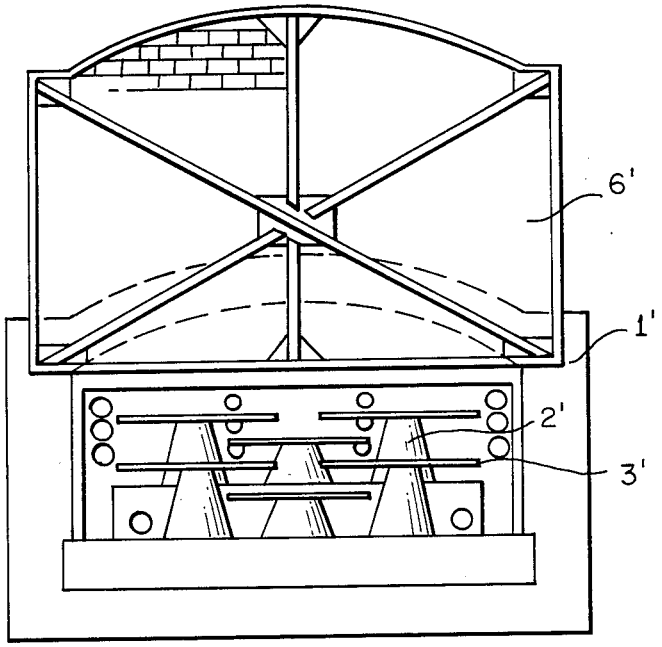
FIG. 6 is a front elevation showing the raised furnace door and the overlapping characteristics of the steel plates when charged and supported within the furnace.
Figure 7:
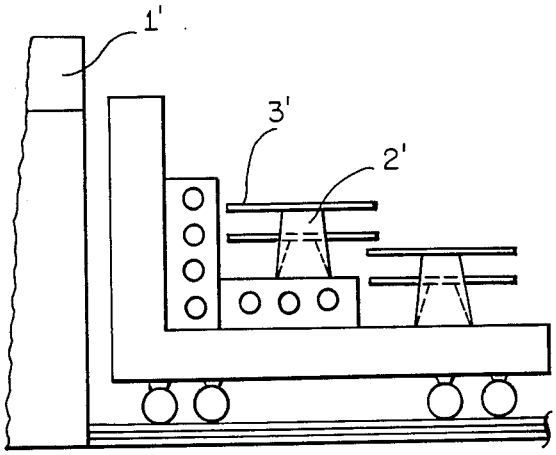
FIG. 7 is a fragmentary side elevation of a modified arrangement wherein the adjustable bed 4' and 5' and the plates are charged into and outwardly by cast carriage 11' having wheels 12' engaging track outside the furnace.

Steel plate workpieces 3' to be heated: a sealing end plate having a nominal diameter of 800 mm is fabricated from blank 3 having a diameter of 1080 mm and a thickness of 14 mm; 30 blanks per batch. The method is effected within a modified, heated bed furnace 1' having a wide or square body, as illustrated in FIG. 2. Six pieces are partially overlapped in a plurality of spaced layers, as illustrated in FIGS. 3 and 5. The various heights of hollow mounds 2' and their respective positions are indicated by English letters in Table 1 and FIGS. 8 and 9. In FIG. 3, the number in arabic numerals and the arrow indicates the sequence of workpieces being charged into and removed from furnace 1'. For example, the arrow from 4 to 5 indicates that piece D is being removed from the furnace as piece F is being charged within the furnace. One workpiece is charged into the furnace and another one is removed every time furnace door 6' opens. As illustrated in Table 3, FIG. 10, total heating time of workpieces for the first batch of blanks is seventeen minutes; then gradually reduced with each additional batch. For example, when the workpiece group from batches Nos. 25 to 30 are within furnace 1', the heating time is twelve minutes. Consequently, blanks 3 are moved continuously in a sequence of charging, heating and removing. Each blank 3 has an interval of two minutes and every batch has an interval of 7 to 2 minutes. The heating rate of blanks and operation in rhythm is accelerated with furnace working time, while achieving good matches of temperatures at the interface of furnace, workpiece, mould, and environment, enabling the sealing plate size deflection to be reduced, so that the workpiece has less oxidization and is of good appearance.

Figure 4:
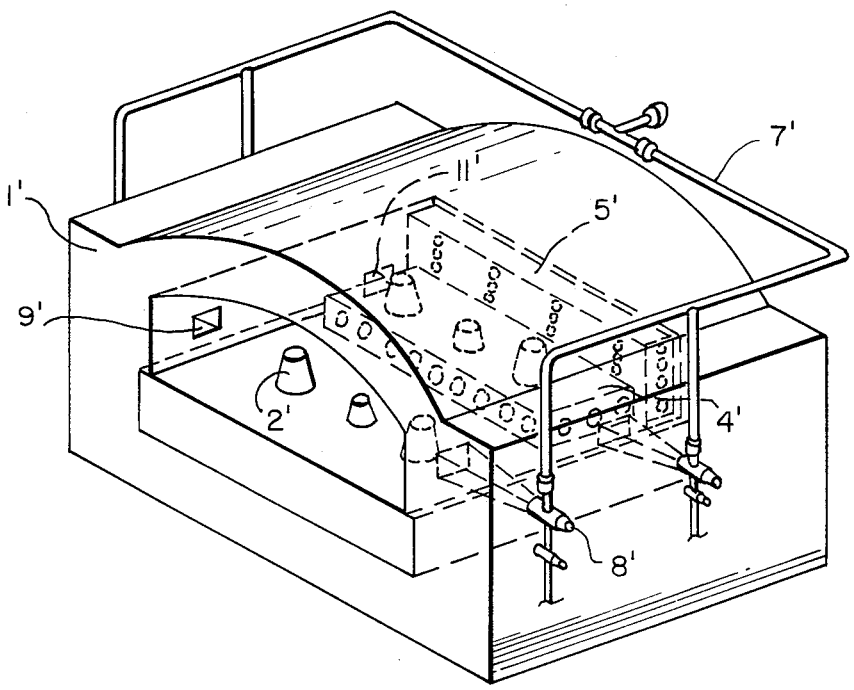
FIG. 4 is a perspective view showing circular mound supports of differing heights for supporting the overlapping steel plates in an array of horizontal layers.

FIG. 4 illustrates a furnace 1' provided with four identical burners 8', two burners being positioned on each side of the furnace and bed by a unitary gas feed conduit 7'. Burners 8' are positioned so that heat is discharged through apertures 9' in the sides of the furnace and thereafter the heated gases are carried by convection through apertures 10' defined in the bed 4' and wall 5'.

In the FIG. 4 arrangement, the height from the floor to the top arch of furnace 1' is approximately 1400 to 1500 meters; the height of the side wall of the furnace is approximately 1,000 mm; the distance between the two burners 8' on each side wall is about 700 mm; the distance from the lower edges of the burner holes 9' on the side walls and near the furnace door to the floor of the furnace is about 400 mm and from the upper edge of holes 9' to the top of the wall is about 900 mm; the burner holes 9' near the rear walls are positioned about 150 mm lower than the holes 9' in the front of the furnace.

Temperature within the furnace may be detected by conventional heat conductive couplers. The heat value detected may either be displayed on a meter panel or recorded by conventional instrumentation and may be used to proportionally and automatically control burners 8' throug electro-magnetic valves, so as to adjust the flow of fuel and to keep the furnace temperature at a proper level. Under normal operating conditions, the furnace temperature is maintained at approximately 1,000° C., for example 980°-1050° C. during practical operation. In wintertime, the furnace temperature is maintained at about 10°-20° C. and in summertime, the furnace temperature is maintained at approximately 960° C.

Figure 8:
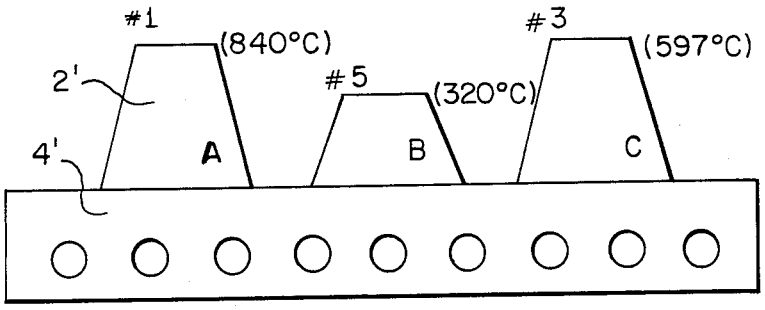
FIG. 8 is a schematic view showing the height of the upper layer circular mounds and achieved temperatures, during heating of "Batch No. 1".
Figure 9:
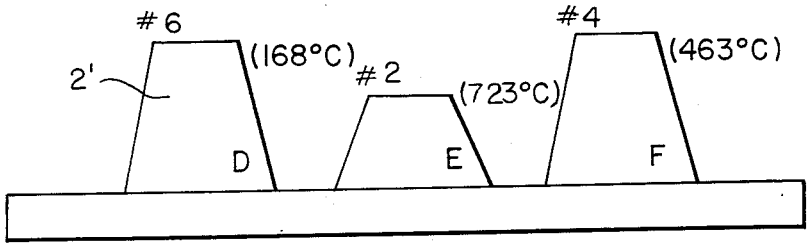
FIG. 9 is a similar schematic showing height of the lower layer circular mounds and achieved temperatures within the oven, during heating of Batch No. 1.

Applicant points out that in FIGS. 8 and 9 there is illustration of "Batch No. 1" temperatures. The temperature of piece number 1 is given as 840° C., whereas the temperature of piece number 6, which would have been heated for about two minutes, is given as 168° C.

TABLE 1

Height (mm) of hollow mounds, as illustrated in FIG. 3.

| No. of Pieces | A | B | C | D | E | F |
|---|---|---|---|---|---|---|
| Height | 780 | 600 | 780 | 450 | 250 | 450 |

After heating all thirty pieces and forging, comparison of furnaces and technologies between the present invention and prior art is shown in Table 2. It is clear that the furnace according to the present invention has reduced furnace operation time more than 75.6 percent as compared to a conventional furnace and has achieved an energy saving of 86.6 percent while obtaining the best precision in the sealing end size, while eliminating the necessity for finish polishing, selection and fit up to 100 percent.

TABLE 2

Comparison of two kinds of prior art furnace and technology with the present furnace and technology.

| ITEM | Conventional Furnace and technologies | Furnace and Technologies According to the Invention |
|---|---|---|
| Furnace-type | Narrow Body Furnace | Wide (Square) Body Furnace |
| Width X Depth (M) | 2.82 × 3.46 | 3.10 × 2.40 |
| Area of Furnace Bottom ($M^2$) | 9.76 | 7.44 |
| Special Heated Bed (Wall) | No | Have |
| Fuel Injector (Piece) | 8 | 4 |
| Oil Consumption Kg/min | 4 | 2.2 |
| Load Quantity (Piece) | 2 | 6 |
| Laid Mode | Single-layer Plane | Plurality of Layer Space, Overlapped |
| Heating Time of 30 Pieces (min) | 337 | 82 |
| Oil Consumption for Heating (Kg) | 1348 | 180.4 |
| Oil Consumption per Piece (Kg/piece) | 44.9 | 6.01 |
| Heat Consumption per Unit (Kca/Kg) | 4941 | 661 |
| Deflection from Sealing end Diameter (mm) | ±3 | ±1.5 |

I claim:

1. A continuous operation intermittent flame furnace of the type using a plurality of types of fuels as an energy source for heating steel blanks, comprising:
   (a) a confined chamber having a floor, rear, front and side walls; and
   (b) an adjustable refractory bed wall composed of fire bricks arranged as a vertical partition extending across the chamber in front of said rear wall and arranged as a horizontal bed supported upon the chamber floor, and extending towards said front wall, the volume of said bed wall comprising 8 to 16% of said chamber volume.

2. A continuous operation intermittent flame furnace as in claim 1, further including:
   (c) a plurality of circular mounds arranged as individual steel blanks supports on said horizontal bed and said floor, and
   (d) a plurality of steel blanks, each supported upon one of said circular hollow mounds in an array of overlapping layers, said steel blanks being independently positionable and removable from said chamber in rhythm without interfering with the continuous operation of said furnace.

3. A continuous operation intermittent flame furnace as in claim 1, wherein said confined chamber has a width greater than its length.

* * * * *